United States Patent [19]

Lagier

[11] Patent Number: 4,883,143

[45] Date of Patent: Nov. 28, 1989

[54] ANECHOIC COATING FOR ACOUSTIC WAVES

[75] Inventor: Michel Lagier, Le Cannet, France

[73] Assignee: Thomson-CSF, Paris, France

[21] Appl. No.: 262,998

[22] Filed: Oct. 26, 1988

[30] Foreign Application Priority Data

Oct. 27, 1987 [FR] France ..... 87 14826

[51] Int. Cl.[4] ..... E04B 1/82

[52] U.S. Cl. ..... 181/286; 181/175; 181/207; 181/288; 181/290

[58] Field of Search ..... 181/207, 30, 286, 288, 181/208, 290, 294, 295, 175, 198, DIG. 1

[56] References Cited

U.S. PATENT DOCUMENTS

| | | | |
|---|---|---|---|
| 2,830,780 | 4/1958 | Schloss | 181/208 X |
| 3,038,551 | 6/1962 | McCoy et al. | 181/198 |
| 3,120,875 | 2/1964 | Graner | 181/198 |
| 3,123,176 | 3/1964 | Greenberg | 181/198 |
| 3,160,549 | 12/1964 | Caldwell et al. | 181/207 X |
| 3,330,376 | 7/1967 | Warnaka | 181/175 |
| 4,197,920 | 4/1980 | Cluzec et al. | 181/175 |

FOREIGN PATENT DOCUMENTS

| | | |
|---|---|---|
| 0044956 | 2/1982 | European Pat. Off. . |
| 0161458 | 11/1985 | European Pat. Off. . |
| 1293329 | 4/1969 | Fed. Rep. of Germany . |
| 2238411 | 2/1975 | France . |

OTHER PUBLICATIONS

Patent Abstracts of Japan, vol. 9, No. 111, (M-379) [1834], May 15, 1985 & JP- 59231240, 12/25/1984, Vibro-Isolating Member Kumazawa.

*Primary Examiner*—B. R. Fuller

*Attorney, Agent, or Firm*—Oblon, Spivak, McClelland, Maier & Neustadt

[57] ABSTRACT

To manufacture an anechoic coating which prevents a wall from reflecting acoustic waves, the wall is coated with an elastic material of low compressibility, which is highly absorbent under shear stresses, and then with a highly compressible layer of material. A set of plates covers the second layer and vibrates under the effect of the acoustic waves. Rods fixed to these plates transmit these vibrations to the first layer which is thus subjected to shear stresses and dissipates the energy of the vibrations, thus making it possible to avoid the sonar detection of submarines.

5 Claims, 1 Drawing Sheet

ANECHOIC COATING FOR ACOUSTIC WAVES

BACKGROUND OF THE INVENTION

1. Field of the Invention

The present invention relates to anechoic coatings which enable the absorption of sound waves in a wide frequency band and, if necessary, under high hydrostatic pressures in order to evade sonar tracking for example. When a sound wave, more generally an acoustic wave, reaches a wall, a portion of its energy is reflected by another transmitted portion and a third portion is absorbed in the wall. For a wall of this type to be anechoic, i.e. for it to reflect no portion of the incident acoustic wave, this acoustic wave must be entirely transmitted or entirely absorbed, or it must be divided entirely between transmission and absorption.

2. Description of the Prior Art

It is known that, at the interface of two acoustic propagation media, with an impedance $Z_O$ for the medium in which the incident wave is propagated and Z for the medium receiving this wave, the reflection coefficient on this interface is:

$$R = \frac{Z - Z_0}{Z + Z_0}$$

For the energy to be entirely transmitted, Z should be equal to $Z_O$. This is generally impossible because of the materials in question. These materials cannot be acted upon because one of them is in a natural medium, most usually in water, while the other material is a structural material of a structure such as, for example, the steel of a submarine hull.

In these cases, there is a known method for cutting the wall with an intermediate layer tending to make this wall anechoic which partly satisfies the equation $Z=Z_0$ and is, furthermore, absorbent.

If the material is homogenous, these two conditions cannot be met in practice. For, if the the material is to be absorbent, it should show losses. In other words, its dissipation factor should be high. Under these conditions, the impedance Z is complex (i.e. there is a phase shift between the pressure and the speed) while the impedance $Z_0$ is real, at least in the common example of water.

Of course, a complex impedance cannot be equal to a real impedance and the condition of equality of impedances cannot therefore be met.

Furthermore, the absorption of the acoustic waves is defined by an absorption coefficient $\alpha$ which is related to the dissipation factor by the relationship:

$$\alpha = \frac{2\pi}{\lambda} tg\delta.$$

Consequently, between R and o, there is the relationship:

$$R = \frac{\alpha\lambda}{4\pi}.$$

There is a known method of manufacturing a partially anechoic material by embedding solid particles in a matrix formed of an elastomer material. These heterogeneities thus cause diffusion and the appearance in this material of shear waves, thus increasing the absorption coefficient. However, the anechoic power of a material of this type remains limited because of the relationship between the absorption and reflection coefficients, especially at low frequencies.

There is also a known method of manufacturing a partially anechoic coating in which the energy is dissipated by viscous friction. For this, the wall is provided with conduits perpendicular to it. The most widely known structure of this type is the so-called alveolate structure. The back of these conduits is given compressible volumes which include, for example, a foam material comprising gas-filled cells. Depending on the dimensions chosen, especially the length and diameter of the conduits, a matching frequency is obtained for which total anechoic quality is achieved.

A coating of this type is decribed, for example, in French patent No. 84.05558 filed on behalf of the firm ALSTHOM ATLANTIQUE.

Apart from the fact that the anechoic quality is not sufficient in a pass-band centered on the matching frequency, an anechoic coating of this type is difficult to manufacture and is therefore costly.

SUMMARY OF THE INVENTION

The invention proposes an absorbent anechoic coating wherein the acoustic waves, which are compression waves, are used, according to a shearing mode, to excite a highly absorptive material. For this, the acoustic waves are received on a set of plates supported by a layer of compressible material and follow the motion of the acoustic waves. These plates comprise rods which are anchored within a layer of absorptive material. Under the effect of the motion communicated to the rods by the plates, the material is deformed under shear stresses and dissipates the energy coming from the acoustic wave.

BRIEF DESCRIPTION OF THE DRAWING

Other specific features and advantages of the invention will appear clearly from the following description, given as a non-restrictive example and made with reference to the appended drawing of which.

DESCRIPTION OF THE PREFERRED EMBODIMENT

Figure 1:
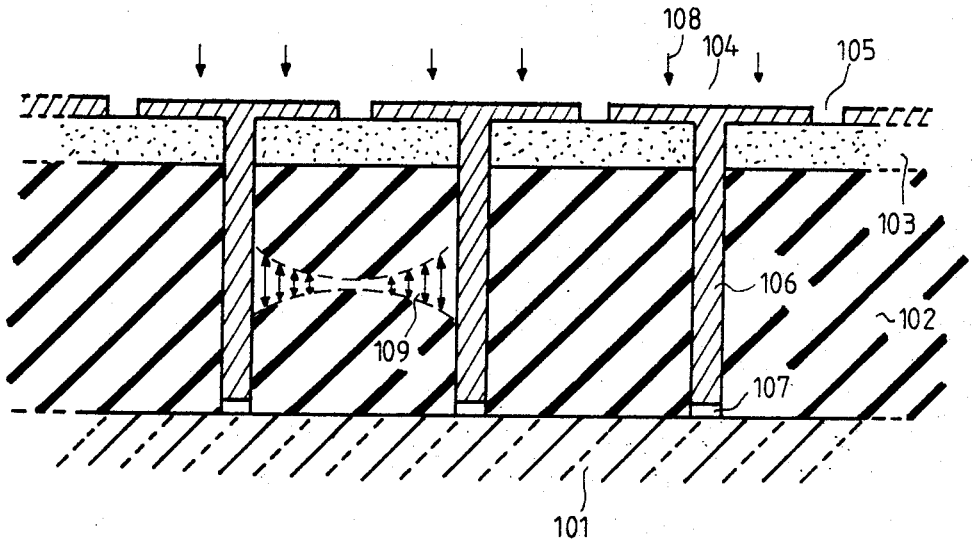
FIG. 1 shows a sectional view of a coating according to the invention.

FIG. 1 shows a cross section view of the wall 101 which is to be given acoustic treatment.

There is fixed on this wall, for example by bonding, a layer 102 of an elastic material such as a highly absorptive elastomer, namely with a high dissipation factor. This elastomer is slightly compressible and very stiff, and also has high resistance to shear stresses.

On top of this layer 102, there is fixed, for example by bonding, a layer 103 formed by a highly compressible material of little stiffness such as, for example, a foam material with enclosed cells.

This layer 103 is coated with a set of plates 104 separated by seals 105. These seals have a minimum width and are therefore just large enough to disconnect the motions of the plates from one another while exposing a minimum area of the layer 103 to the propagation medium which is most commonly water. These plates are rigid and can be made either of metal or of a composite material such as laminated glass fiber or carbon fiber embedded in a resin matrix. Advantageously, their mass is as small as possible.

On each plate, substantially at its middle, there is fixed a rod 106 which penetrates a hole in the layers 103 and 102. This rod 106 is penetrated into this hole by force, so as to be rigidly joined to the walls of this hole and so as to be anchored in the mass of the elastomer layer 102.

The length of this rod is such that it leaves an open space 107 between its lower end and the wall 101, so that it does not touch this wall despite the hydrostatic pressure of the propagation medium and the effect of the acoustic waves.

Under the effect of the pressure of an incident acoustic wave, depicted by the arrows 108, the plates are shifted in a direction perpendicular to the wall 101. Under the effect of this motion, the wall 103 is compressed between the plates and the layer 102. This layer 102 does not undergo appreciable deformations under the direct action of the motion of the plate.

The rods 106 themselves follow the motion of the plates, and since they are joined solidly to the wall of the holes into which they are pushed, they exert shear stresses on the layer 102. The deformation of the material of the layer 102, resulting from this shear stress, is shown in the figure by the arrows 109. Quite naturally, this deformation is at its maximum at the interface between the rod and the layer and decreases towards the medium part between two rods.

The incident compressive acoustic wave is dampened, firstly, by the difference in stiffness between the layers 102 and 103, and secondly, by elastic losses related to the shearing mode in the layer 102.

To obtain the most efficient possible absorption, the parameters of the layers are defined, firstly, according to the impedance matching condition, and secondly, according to the desired resonance frequency which itself corresponds to the frequency at which maximum absorption is desired.

The impedance matching condition is given as a first approximation by the equation $$\rho_0 C_0 S_0 \approx \rho C_s S$$

In this equation, $\rho_0$ and $C_0$ are respectively the density and the speed of compression of water, p and $C_s$ are the density and the shearing speed of the elastomer, $S_0$ is the surface area of a plate and S is the lateral surface area of a rod ($\pi dh$ if d is the diameter and h is the height).

Since the speed $C_s$ depends on the frequency, the value preferably chosen as the value of the frequency $f_0$ for which the above formula is satisfied, is the value corresponding to the resonance frequency of the structure. This resonance frequency is close to:

$$\frac{1}{2\pi}\sqrt{\frac{1}{MC}}$$

wherein $M_c$ is the mass of a set of plates and rods and $C_{el}$ is the equivalent shearing compliance of the elastomer.

Under these conditions, anechoism equal to 100% at this frequency $f_0$ is obtained.

Since it is necessary, besides, to prevent an antenna effect wherein the plates, excited by incident radiation, start radiating in turn, the plates are dimensioned in such a way that their greatest dimension and spacing is far smaller than the mean wavelength in an acoustic band wherein an anechoic effect is sought to be obtained. As an alternative, an alignment of plate/rod sets may be replaced by a T-shaped structural section, the vertical arm of which is anchored in the elastomer layer and the maximum length of which meets this condition.

One method for manufacturing a coating according to the invention starts with a rigid plate made of metal or composite material on which the rods are fixed by a suitable process, for example screwing, soldering, force-fitting or by a thermal shrink-on process. Then, a layer of foam rubber is pierced at the location of the rods and then this layer is fitted onto these rods in such a way that it lies on the rigid plate. After placing this set in a mold, the edges of which are sufficiently high, the elastomer layer is cast and gets molded on the foam rubber layer and around the rods for which it has been seen to it that they are extended by sleeves. After the elastomer is polymerized, the set is demolded, the sleeves are removed so as to obtain the spaces 107 at the end of the rods, and then the plates are separated by making, for example, saw-toothed lines which create the seals 105.

In a practical embodiment, the dimensions of the anechoic coating are as follows:

square-shaped plates 20 mm. square;
length of rod: 60 mm.;
diameter of rod: 6 mm.;
thickness of foam: 10 mm.;
thickness of elastomer: 55 mm.

The plates are made from a steel plate with a thickness of 1 mm. and, in this example, the rods are formed from a steel tube with a thickness of 1 mm. so as to be hollow so that the mass of the entire unit is not excessive.

The elastomer material used is a polyurethane material with the following characteristics:

dissipation factor=0.5;
speed of compression waves: 1700 ms;
speed of shearing waves: 207 m/s;
density: 1120 kg. per m/3.

The layer of compressible foam is made, in this example, with a polyurethane similar to that of the elastomer layer but one that is processed to obtain a foam with a density of 740 kg./m3 under a pressure of 30 bars, wherein the speed of the compression waves is equal to 410 m/s. A material of this type retains its compressibility characteristics under high pressures of 30 bars for example, and therefore enables the anechoic coating to work under deep immersion, for example 300 m., for this same pressure of 30 bars.

Figure 2:
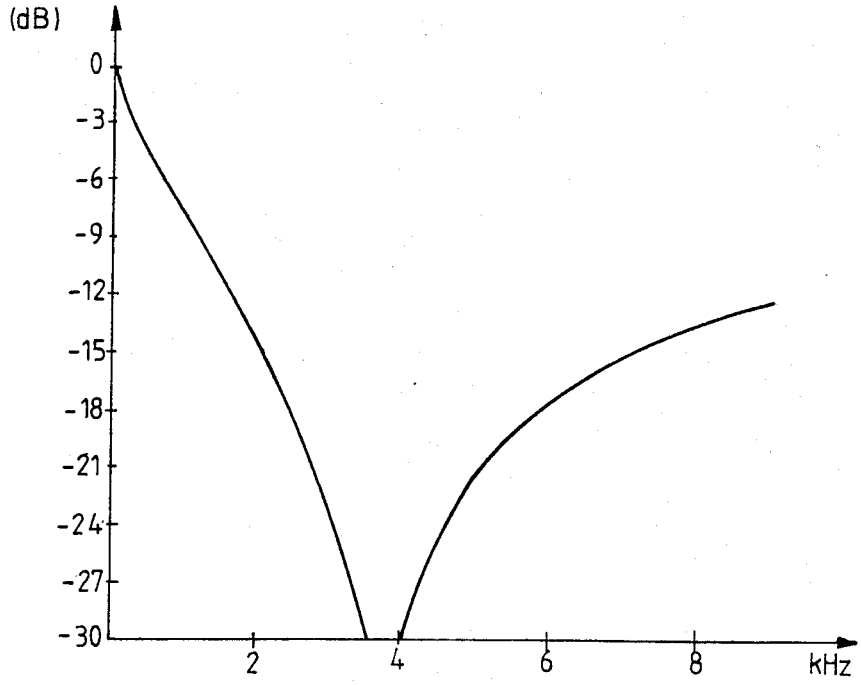
FIG. 2 shows an attenuation curve as a function of the frequency of the incident wave.

FIG. 2 shows the attenuation as a function of frequency. It is noted that the resonance frequency is in the region of 4 kHz and that an attenuation of over −15 dB is obtained in a pass-band ranging from 2 to 7 kHz.

Obviously, numerous modifications and variations of the present invention are possible in light of the above teachings. It is therefore to be understood that within the scope of the appended claims, the invention may be practiced otherwise than as specifically described herein.

What is claimed is:

1. An anechoic coating for acoustic waves, adapted to be placed on a reflecting wall, comprising:

a first layer of elastic material of low compressibility, which is highly absorbent under shearing waves, and which is fixed at one surface thereof to said wall;

a second layer of highly compressible elastic material fixed to an opposite surface of the first layer;

a set of rigid plates fixed to the second layer opposite said first layer to receive the acoustic waves; and a set of rigid rods fixed to a bottom portion of the plates, which extend through the second layer and anchored in the first layer to exert shear stresses on the first layer in response to acoustic waves received by the plates.

2. A coating according to claim 1 wherein the plates cover an entire surface portion of the second layer and which comprises a seal with a minimum width located between said plates.

3. A coating according to claim 1 wherein the second layer is formed of a foam material comprising gas-filled alveoli.

4. A coating according to claim 3 wherein the second layer is formed of a polyurethane elastomer.

5. A coating according to claim 1, wherein a speed of said acoustic waves in a fluid medium and in the first layer, and a density of said fluid medium and said first layer provides an impedance matching under compression and shear stresses, said impedance matching being determined by the equation:

$$\rho_0 C_0 S_0 \simeq \rho C_s S$$

for a frequency determined by:

$$f_0 = \frac{1}{2\pi} \sqrt{\frac{1}{M_c C_{el}}}$$

wherein $\rho_0$ and $C_0$ are respectively the density and speed of compression of said fluid medium, $\rho$ and $C_s$ are the shearing speed of an elastomer, $S_0$ is a surface area of one of said plates and S is a lateral surface area dimension of said rods, $M_c$ is a mass of a set of said plates and rods and $C_{el}$ is an equivalent shearing compliance of the elastomer.

* * * * *